US005293811A

United States Patent [19]

DeLair et al.

[11] Patent Number: 5,293,811

[45] Date of Patent: Mar. 15, 1994

[54] MISSILE CONTROL FIN ACTUATOR SYSTEM

[75] Inventors: Charles M. DeLair; Russell B. Cline, both of Tucson, Ariz.

[73] Assignee: Hughes Aircraft Company, Los Angeles, Calif.

[21] Appl. No.: 739,570

[22] Filed: Aug. 2, 1991

[51] Int. Cl.[5] ..... F01B 19/00

[52] U.S. Cl. ..... 92/49; 92/98 D; 92/137; 92/251

[58] Field of Search ..... 91/361; 92/49, 64, 68, 92/76, 98 D, 137, 140, 143, 251; 74/89.2

[56] References Cited

U.S. PATENT DOCUMENTS

| | | | |
|---|---|---|---|
| 3,020,008 | 2/1962 | Rumsey | 91/438 |
| 3,063,423 | 11/1962 | Riordan | 92/140 |
| 3,125,000 | 3/1964 | Reuter | 92/68 |
| 3,301,141 | 1/1967 | Griffing | 92/143 |
| 3,673,861 | 7/1972 | Handy | 92/98 D |
| 3,767,160 | 10/1973 | McCollum | 92/98 D |
| 4,000,226 | 12/1976 | Laprade et al. | 92/64 |
| 4,366,722 | 1/1983 | Hasler | 74/89.2 |
| 4,754,776 | 7/1988 | McKee | 92/98 D |
| 4,759,262 | 7/1988 | Hay | 92/68 |
| 4,763,560 | 8/1988 | Sasaki | 91/361 |
| 4,800,798 | 1/1989 | Boldrin et al. | 91/361 |

OTHER PUBLICATIONS

Stewart et al, Fluid Power, copyrighted 1980, Bobbs-Merrill Educational Publishing pp. 318–323.

Handbook of Applied Instrumentation, Considine et al editors, copyrighted 1964, McGraw-Hill Book Co.

*Primary Examiner*—Edward K. Look
*Assistant Examiner*—F. Daniel Lopez
*Attorney, Agent, or Firm*—Randall M. Heald; Charles D. Brown; Wanda K. Denson-Low

[57] ABSTRACT

A control fin actuator (28) for a guided missile (20) includes a pressure actuator (40) having a slidable piston (44) inside a housing (42). Rolling diaphragm seals (50, 56) of the top piston face (46) and the bottom piston face (48) to the inside wall of the housing (42) divide the interior of the housing (42) into at least two chambers (54, 58). The rolling diaphragm seals (50, 56) eliminate sliding friction as the piston (44) moves within the housing. The two chambers (54, 58) are controllably pressurized to slide the piston (44) within the housing (42), thereby moving a push rod (78) attached to the piston (44) and extending out of the housing (42). The push rod (78) is connected to a missile control fin output shaft (24) by a taut band connector (80) that avoids backlash. A magnet (86) may be positioned adjacent to the push rod (78) to induce eddy currents in the push rod (78), thereby providing a damping force that increases with increasing rate of movement. Pressure in the control chamber (54) is achieved by operating the inlet valve (70) and the exhaust valve (72) in response to feedback information from a rotary position sensor (29), a linear position sensor (88), and/or pressure sensors (90, 92).

15 Claims, 4 Drawing Sheets

MISSILE CONTROL FIN ACTUATOR SYSTEM

BACKGROUND OF THE INVENTION

This invention relates to the control of guided missiles, and, more particularly, to an approach for controlling the guidance fins of such missiles.

Most guided missiles are controlled and stabilized with movable control surfaces or fins that project from the sides of the missile, typically near its rearward end. The fins, or possibly only a portion of the fins in larger missiles, are normally of symmetrical cross section and are pivotably mounted in the airstream. When each fin is oriented parallel to the airstream, there is no control force exerted on the missile. By pivoting the fins to be oriented at an angle with respect to the airstream, there is a resulting control force exerted on the missile and its direction or roll orientation is changed.

Some missiles may fly as fast as several times the speed of sound, and therefore control movements of the fins must be accomplished quickly and smoothly in response to a control signal. Control operations and consequent movements of the fins may be updated continuously by the missile electronics or commanded as often as several thousand times per second by a digital computer. The actuator mechanism which converts the electrical command signals to physical movement of the control fins must respond at high rates to maintain the maneuverability and stability of the high speed missile, minimizing dynamic behavior which might otherwise cause the fin not to follow the command exactly.

Two types of fin actuator systems are generally in use today. They are electromechanical systems and fluidic systems. In the former, command signals are translated to physical movement by a sophisticated electric motor, typically with a precision gear train. In the latter, which include both hydraulic and pneumatic systems, the command signal controls pressurizing valves and release valves that regulate the pressure in a cylinder with a movable piston, causing the piston to slide back and forth within the cylinder. A push rod extends out of the cylinder and is connected to a control fin output shaft upon which the fin is mounted.

Each type of actuation system, while operable in some conditions, has its drawbacks. The electromechanical system is considered to offer the higher response capability, but it may be costly, electronically and mechanically complex, difficult to build, difficult to calibrate and test, and lacking in reliability in some applications. Due to the nature of motor control, electromechanical actuation systems have certain inherent performance limitations under high fin torsional loads that may be more successfully accommodated by fluidic systems. The hydraulic and pneumatic systems can meet response requirements up to 100 cycles per second only if very precise internal tolerances are maintained, and if sophisticated valve, seal, and mechanical arrangements are devised. Even then, these systems tend to be more sensitive to nonlinear effects such as friction and backlash. The entrapped fluid in the hydraulic systems is often subject to leakage over long periods of storage, which makes periodic maintenance necessary.

The control actuator must be operable over a wide range of environmental conditions, including temperature, vibration, acceleration, and high structural and fin loadings. For example, some military specifications require that the missile be storable for extended periods and thereafter operable over temperatures ranging from as low as −65° F. to as high as +190° F. The actuator for the control surfaces must be made of materials that achieve satisfactory strength and other properties over the entire environmental range, and additionally must retain its performance in all specified environments.

Because of the inability of conventional pneumatic systems to meet the most demanding performance requirements over widely varying conditions, electromechanical actuators are most widely used today in high-performance missile control systems. However, as indicated, they tend to be costly, complex, prone to breakdown and performance anomalies, and difficult to test. There is therefore a need for an improved actuator system that has acceptable performance responses as well as low cost and good reliability over a range of operating conditions. The present invention fulfills this need, and further provides related advantages.

SUMMARY OF THE INVENTION

The present invention provides an actuator for missile fins that is relatively low cost, reliable, readily tested and calibrated, and stable in operation. The actuator achieves excellent control without mechanical backlash. It is fully operable to rates approaching 100 cycles per second over a wide temperature range, and has good stability characteristics at both low and high rates.

In accordance with the invention, a missile control fin actuator that produces rotation of a control fin output shaft is embodied in a pressure actuator, including a housing and a piston slidable within the housing to define at least two pressure chambers within the housing. A rolling diaphragm seal is placed between the piston and the housing wall, the rolling diaphragm seal providing a pressure seal between the pressure chambers. A push rod is connected to the piston and extends out of the housing. Means is provided for controllably pressurizing the two pressure chambers to cause the piston to slide within the housing. There is also provided means for connecting the push rod to a control fin output shaft.

The push rod is preferably connected to the fin output shaft by a taut band connector which avoids backlash when the direction of movement of the piston changes. A magnet may be placed adjacent to the push rod to induce eddy current damping in the system, which increases with increasing rate of operation. The chamber pressures, and position and rate of movement of the push rod and/or the fin output shaft may be monitored, and the sensor indications fed back to the pressurization control for adjustment of the control parameters.

The actuator of the invention is generally of the pneumatic type. In prior pneumatic actuators, ring seals were used between the piston and the interior wall of the housing to define the two pressure chambers. Ring seals, or other dynamic sliding seals, create a nonlinear sliding frictional component whose effect varies widely with temperature and increases with increasing operational frequency of the actuator. Wear of the seals against the interior walls of the housing routinely causes scoring and other damage, reducing the performance of the actuator. The friction caused by the seals can be reduced to reduce wear damage, but then some other mechanism to achieve control damping must be used. The prior pneumatic actuators were difficult to tune and maintain in adjustment over extended storage periods in extreme conditions.

The rolling diaphragm seals used in the actuator of the invention greatly reduce wear as compared with sliding seals, and also greatly reduce any environmental effects on performance such as those due to temperature changes. The close-fitting tolerances of the prior pneumatic actuators are no longer required, with the result that temperature changes have much less effect on actuator performance, and the further result that manufacturing costs are substantially reduced. The reduction of sliding friction improves the efficiency of the pneumatic control process and improves high frequency performance. With elimination of the frictional damping effect of the prior dynamic sliding seals, auxiliary damping sources including damping orifices in the pneumatic lines and magnetic eddy current damping may be introduced.

The pneumatic actuator of the invention thus provides an important control advance for missile fin control systems. High performance over a wide environmental range, good storage capability, and excellent reliability are achieved in an actuator that is readily manufactured and calibrated. Other features and advantages of the invention will be apparent from the following more detailed description of the invention, taken in conjunction with the accompanying drawings, which illustrate, by way of example, the principles of the invention.

DETAILED DESCRIPTION OF THE INVENTION

Figure 1:
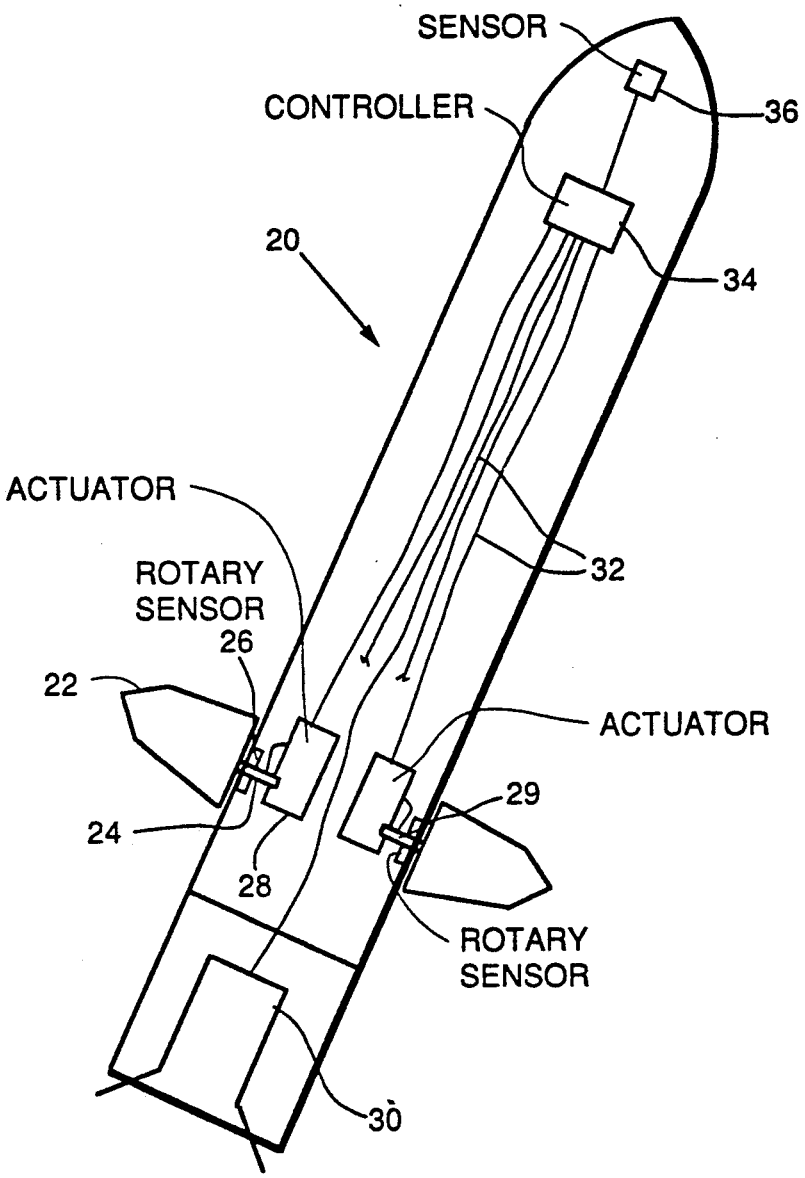
FIG. 1 is a diagrammatic perspective view of a guided missile, with the skin of the missile removed to illustrate the fin actuator.

FIG. 1 depicts a missile 20 having control fins 22 projecting from the sides of the missile. (Two of the four fins normally present are shown, and the other two are not visible because they are out of the plane of the illustration.) Each fin 22 is mounted to a fin output shaft 24, which in turn is supported in a bearing 26. To control the direction of movement of the missile 20, an actuator 28 causes the shaft 24 to turn, thereby changing the angle of the fin 22 with respect to the airstream. The movement of the shaft 24 may be monitored by a rotational sensor 29.

The missile 20 is powered by a rocket engine or motor 30, here illustrated as a single motor nozzle in the tail. Alternatively, multiple rearwardly angled smaller motor nozzles may be provided on the sides of the missile body.

The actuators 28 and the motor 30 are controlled by signals transmitted thereto on signal lines 32 from an on-board controller 34. A sensor 36 such as a heat seeker is sometimes provided in the nose of the missile 20. The missile may also be guided by radio, wire, or optical fiber from its base.

The present invention relates primarily to the structure and operation of the actuator 28.

In accordance with the invention, a missile control fin actuator that produces rotation of a control fin output shaft comprises a housing and a piston assembly slidable within the housing. The piston assembly includes a first face having a first cross sectional area and a second face having a second cross sectional area different than the first cross sectional area. A first rolling diaphragm seals the first face to the interior wall of the housing, thereby defining a first pressure chamber between the first face and the interior of the housing. A second rolling diaphragm seals the second face to the interior wall of the housing, thereby defining a second pressure chamber between the first face and the second face. A push rod is connected to the piston assembly and extends out of the housing. There is further provided means for controllably pressurizing the two pressure chambers to cause the piston to slide within the housing, and means for connecting the push rod to a control fin output shaft.

Figure 2:
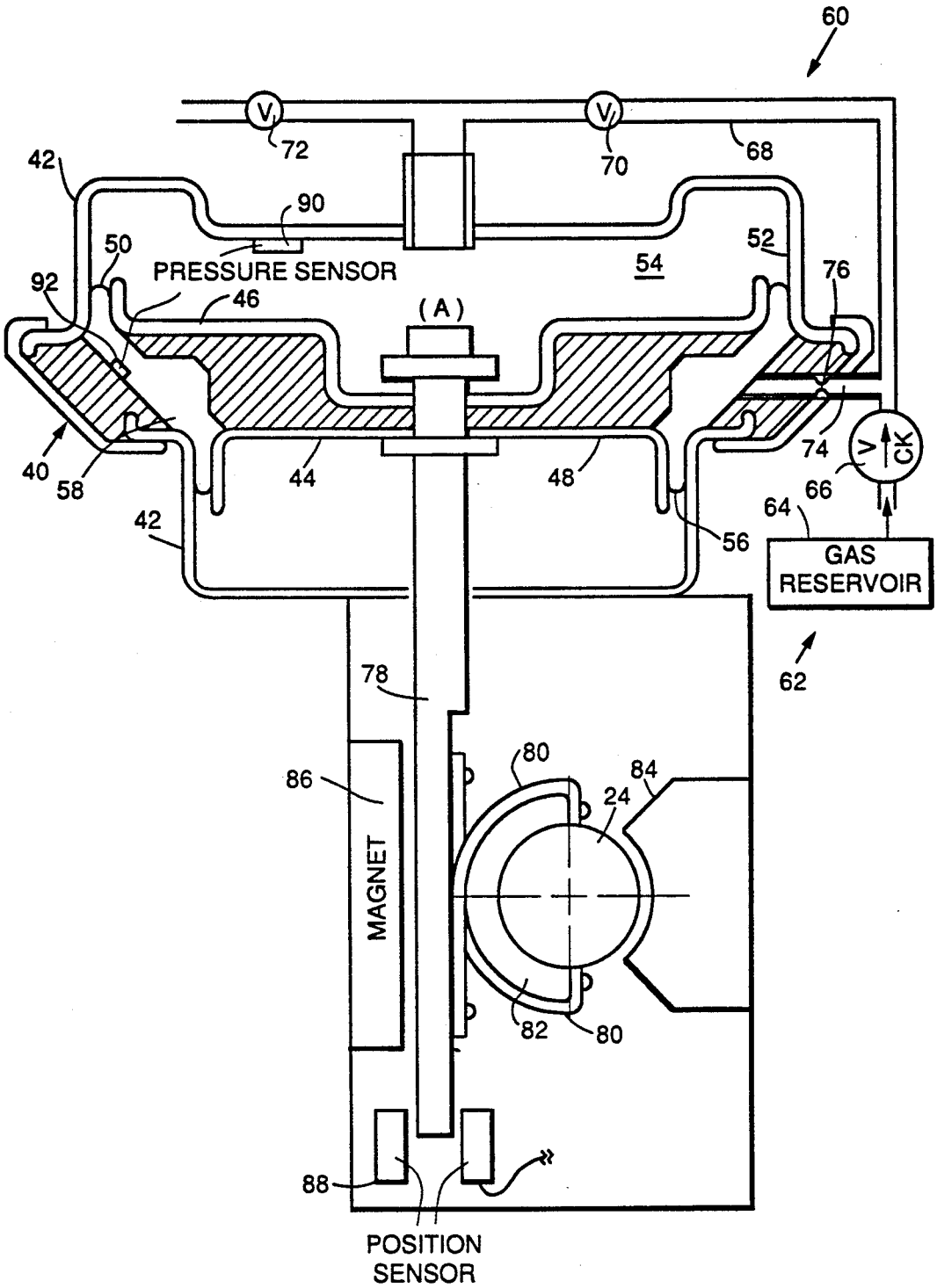
FIG. 2 is a schematic sectional view of an actuator.

A pneumatic actuator 40 in accordance with this embodiment of the invention is illustrated in FIG. 2. The actuator has a housing 42 which is formed of two generally cylindrical sections of different diameters joined together. The different diameters are used because of the dual-area piston of this approach.

A piston assembly 44 is hollow with a first face 46 having a first projected area, and a second face 48 having a second projected area. Preferably, the ratio of the first projected area to the second projected area is about 2:1.

A first rolling diaphragm 50 seals the first face 46 to the adjacent portion of an interior wall 52 of the housing 42. There is thus defined a first pressure chamber 54 between the interior wall 52 and the first face 46 and its associated first rolling diaphragm 50. A second rolling diaphragm 56 seals the second face 48 to its adjacent portion of the interior wall 52. There is thus defined a second pressure chamber 58 within the volume bordered by the first face 46 and its associated first rolling diaphragm 50, the second face 48 and its associated second rolling diaphragm 56, and the interior wall 52 of the housing 42.

The rolling diaphragms are constructed from an elasticized material that has high radial flexibility but low circumferential expansion. Their construction and use are described in U.S. Pat. Nos. 3,137,215, 3,373,236, and 3,969,991, which disclosures are herein incorporated by reference. The rolling diaphragms used as seals are a specialized product available commercially from Bellofram Corporation, Newell, W. Va., for example. As illustrated in FIG. 2, the radial clearance between the piston assembly 44 and the interior wall 52 can be made quite large, because the seal is accomplished by the flexible, fabric-like rolling diaphragm material. The large clearance permitted by the use of the rolling diaphragm has two important consequences. First, manufacturing costs are reduced significantly, because maintenance of tightly controlled tolerances is a costly portion of the manufacturing operation for conventional pneumatic actuators. Second, the actuator is much less subject to variations in performance with environmental changes such as temperature changes. Such performance variations result in large part from the changes in dimensional relationships as a result of thermal expansion differences in closely dimensioned systems.

The two pressure chambers 54 and 58 may be controllably pressurized by a pressurization system 60 to move the piston assembly 44 along the length of the housing 42. The pressurization system 60 includes a source of pressurized gas 62 including a gas reservoir 64 and a regulator 66 that ensures constant pressure. A first gas pressure line 68 extends from the gas source 62 through the wall of the housing 42 and into the first pressure chamber 54. The first gas pressure line 68 has a solenoid-controlled inlet valve 70 therein to control the flow of gas from the source 62 into the first pressure chamber 54. A solenoid controlled exhaust valve 72 also communicates with the first pressure chamber 54 to controllably release pressure from the chamber 54. A second gas pressure line 74 extends from the gas source 62 through the wall of the housing 42 and into the second pressure chamber 58. The second gas pressurization line 74 preferably includes an orifice 76 therein to supply damping in the gas system during high frequency operation.

In this embodiment, the second pressure chamber 58 is constantly pressurized to the pressure P of the source 62 through the open line 74. In the absence of pressure in the first pressure chamber 54, the upward force on the first rolling diaphragm 50 is PA, where A is the area of the first face 46. The downward force on the second rolling diaphragm 56 is PA/2, because in the preferred embodiment the area of the second face 48 is one-half that of the first face 46. There is a net upward force of PA/2 tending to lift the piston assembly 44.

The piston assembly 44 is forced downwardly by opening the inlet valve 70, producing a maximum downward force PA in the first pressure chamber 54. The piston assembly is thereby forced downwardly with a net force of PA/2. Downward movement can be halted and the piston assembly moved upwardly by opening the exhaust valve 72 to reduce the pressure, and thus the downward force in the first pressure chamber 54. Operation of the actuator 40 therefore is accomplished by varying the pressure in chamber 54 solely through control of the valves 70 and 72 by the controller 34, with the pressure required to move the piston supplied by the expansion energy of the stored gas mass in the gas reservoir 64.

A push rod 78 is fastened to the piston assembly 44 and extends outwardly from the housing 42 through the volume defined by the interior wall 52 and the second face 48, which is at atmospheric pressure. The push rod 78 is sufficiently long to reach to a position adjacent the shaft 24. The push rod 78 is connected to the shaft 24 by a pair of metallic taut bands 80. One end of each band 80 is fastened to the push rod 78. The other end is bent around the circumference of a fastener block 82 supported on the shaft 24. A stop block 84 is positioned to act as a physical limit for the movement of the fastener block 82 in each direction. This arrangement of taut bands eliminates backlash when the direction of movement of the push rod 78 is changed.

The push rod 78 is actuated by a compressed gas mass in the actuator 40, which acts in a spring-like fashion during dynamic movement. To damp out the resonance that would otherwise result, prior art pneumatic actuators could rely on the friction between the piston and the housing wall created by the sliding seal. That friction is frequency and temperature dependent in a nonlinear manner, the primary cause of loss of performance at high frequencies and at temperature extremes in prior pneumatic actuators.

Two types of damping are utilized in the present actuator 40. The first is damping by gas expansion through the fixed orifice 76 and through the valves 70 and 72. The second is eddy current damping produced by placing a magnet 86 adjacent to a portion of the metallic push rod 78. As the push rod 78 moves, eddy current forces that tend to oppose the motion are generated by the magnetic field of the magnet 86. These forces increases with increasing rate of movement of the push rod 78 in the magnetic field, so that the damping increases linearly with increasing rate of movement of the push rod 78, the desired result to achieve system stability. For particular applications, the strength of the magnet can be adjusted as necessary, or omitted.

The actuator 40 is preferably operated in a feedback control mode using sensors that measure the mechanical movement of the push rod 78 or shaft 24 resulting from the pressurization sequences discussed previously. Sensors that measure the pressure in the chambers 54 and 58 may also be used as a means to control the valves. Specifically, the linear position and movement of the push rod 78 can be measured by a sensor 88 such as a linear optical encoder. The rotational position and movement of the shaft 24 can be measured by the rotational sensor 29 described previously and illustrated in FIG. 1, such as a rotary potentiometer or a rotary optical encoder. The chamber pressures can be measured by high bandwidth pressure sensors 90 and 92 such as strain gauge pressure transducers. The outputs from the sensors 88, 90, 92, and/or 29 are supplied to the controller 34, which uses the information to control the opening of the solenoid operated valves 70 and 72.

Figure 3:
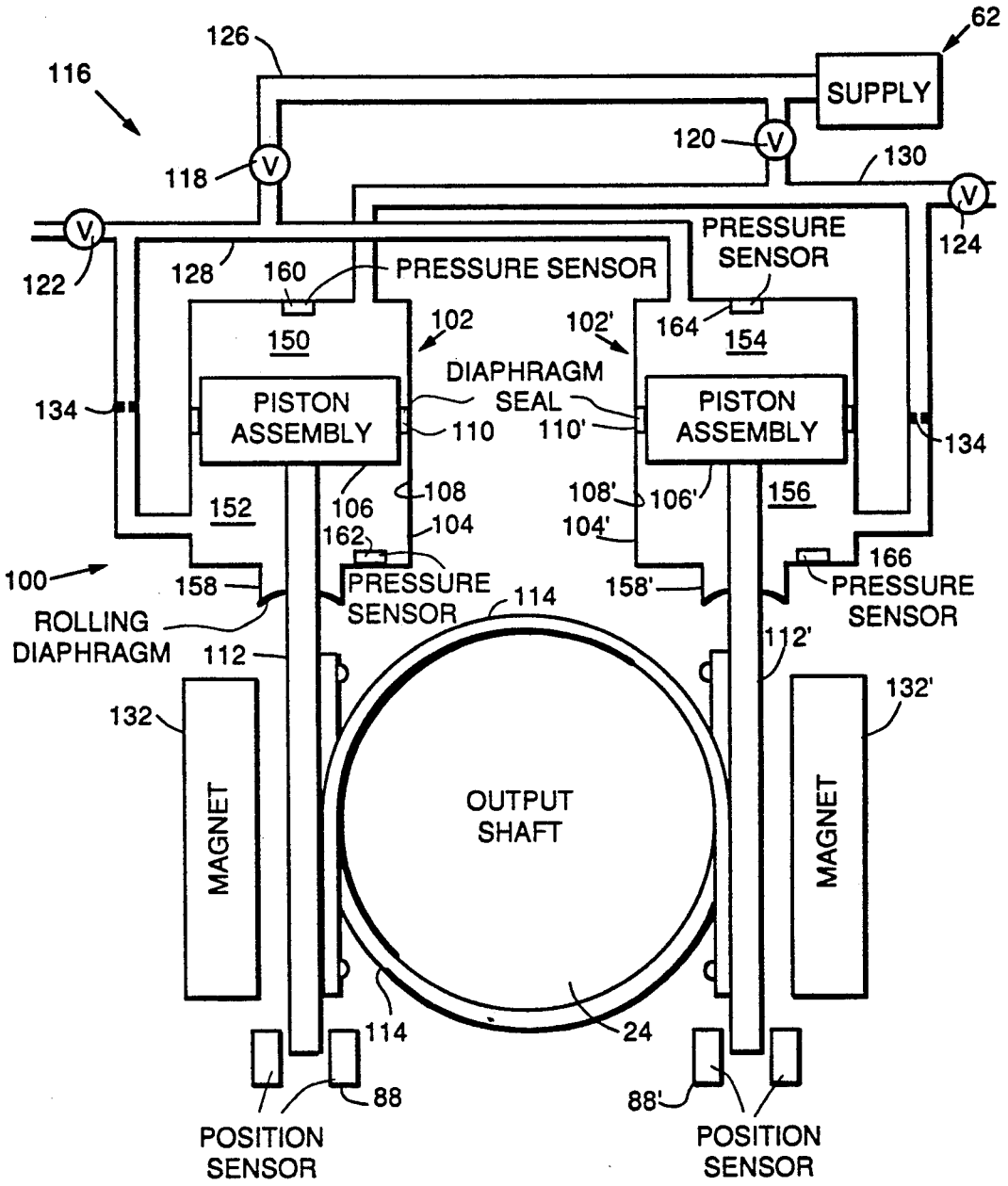
FIG. 3 is a schematic sectional view of another embodiment of actuator.
Figure 4:
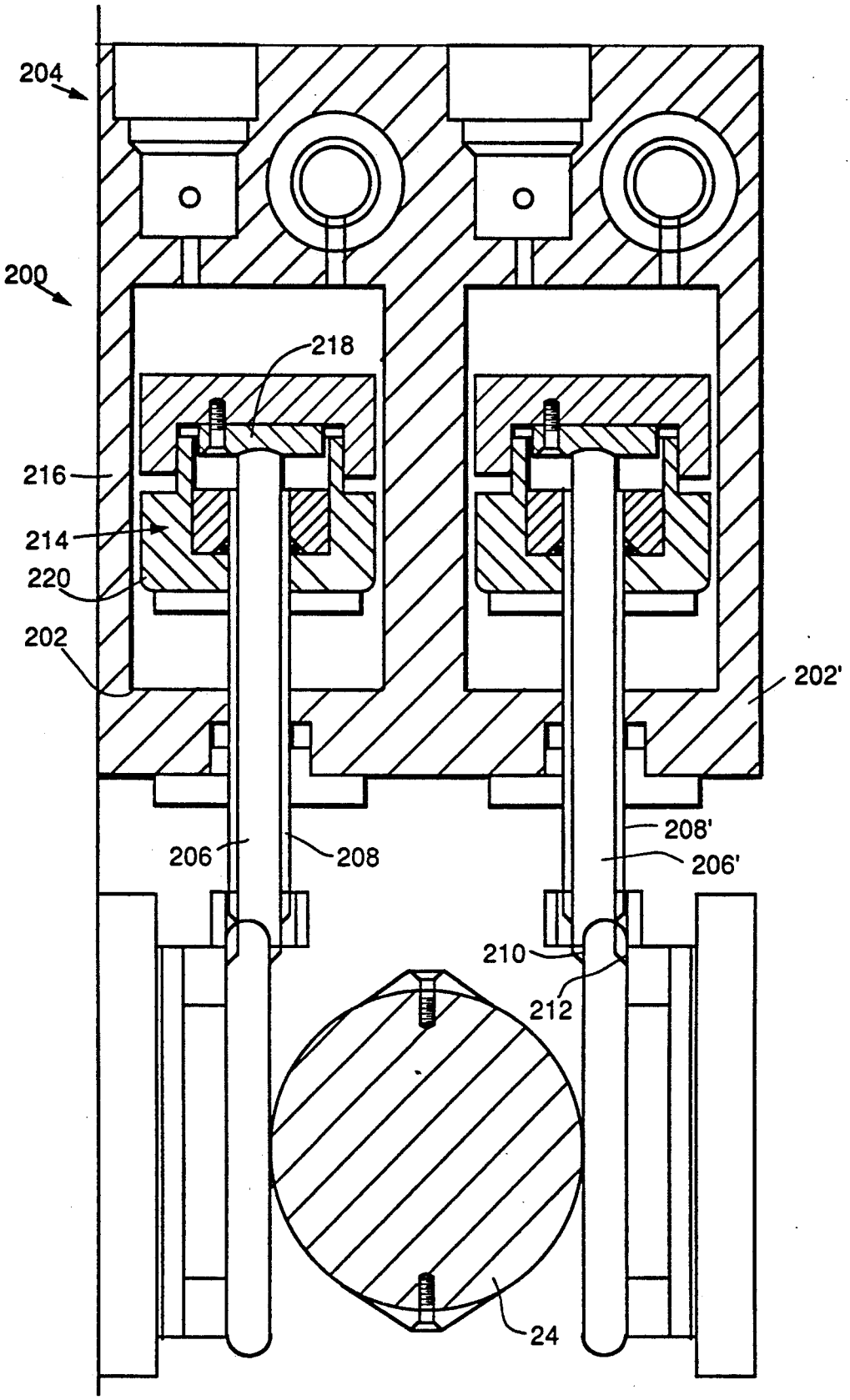
FIG. 4 is a schematic sectional view of a hardware implementation of the actuator of FIG. 3.

The constructional techniques of the invention can be applied in other forms of actuators, two of which are illustrated in FIGS. 3 and 4.

An actuator 100 of FIG. 3 utilizes two oppositely acting pressure actuators 102 to apply a torque to the shaft 24. Each pressure actuator 102 has a housing 104 in which a piston 106 slides. (The respective comparable elements will be numbered with no primed notation for the left hand pressure actuator, and with a primed notation for the right hand pressure actuator.) In this illustrated embodiment, the piston 106 is made as a single area piston rather than the dual area piston of FIG. 2, but either form may be used. Each piston 106 is sealed to an interior wall 108 of the housing 104 with at least one rolling diaphragm seal 110. In the illustrated embodiment, two such seals 110 are used in each housing. There is thereby defined in the first pressure actuator 102 an upper pressure chamber 150 and a lower pressure chamber 152; and in the second pressure actuator 102' an upper pressure chamber 154 and a lower pressure chamber 156.

A push rod 112 is fastened to the piston 106 to move with it. The push rod 112 is sealed to the pressure actuator housing 104 by a rolling diaphragm 158, thereby completing the lower pressure chamber 152 in actuator 102, and the lower pressure chamber 156 in actuator 102'. The push rod 112 extends out of the housing 104, and is fastened to the shaft 24 with a pair of taut bands 114. In the illustrated form, each taut band 114 is fastened at one end to one of the push rods 112, bent around the shaft 24, and fastened at the other end to the other of the push rods 112'.

For this configuration to be operable, the push rods 112 and 112' must move in opposite directions in a coordinated fashion. A pressurization system 116 with cross connected supply lines permits this movement. In the system 116, there are two solenoid-actuated inlet valves 118 and 120, and two solenoid-actuated exhaust valves 122 and 124. A primary pressurization line 126 extends from a common gas source 62 comparable to that described previously to each of the inlet valves 118 and 120. A first gas distribution line 128 communicates from the downstream side of the first inlet valve 118 to the lower pressure chamber 152 of the first pressure actuator 102 and to the upper pressure chamber 154 of the second pressure actuator 102'. The exhaust valve 122 communicates with this first gas distribution line 128. A second gas distribution line communicates from the downstream side of the second inlet valve 120 to the upper pressure chamber 150 of the first pressure actuator 102 and to the lower pressure chamber 156 of the second pressure actuator 102'. The exhaust valve 124 communicates with this second gas distribution line 130.

The operation of the actuator 100 to produce opposite movement of the push rods 112 and 112' is achieved with the proper pressurization sequencing of the valves 118, 120, 122, and 124. For example, the opening of the valves 118 and 124 with the valves 120 and 122 closed will make the left hand piston 106 move upwardly and the right hand piston 106' move downwardly at the same rate, applying a clockwise torque to the shaft 24. Conversely, the opening of the valves 120 and 122 with the valves 118 and 124 closed will make the left hand piston 106 move downwardly and the right hand piston 106' move upwardly, applying a counter-clockwise torque to the shaft 24. Feedback sensors comparable to the sensors 88 and 29, described previously, are preferably provided as an aid to controlling the opening and closing of the valves 118, 120, 122, and 124. Chamber pressure sensors 160, 162, 164, and 166, like those described previously, may also be used independently or in concert as a means to control the valves and achieve the proper pressure balance.

Damping magnets 132 and gas flow damping orifices 134 are optionally provided in the actuator 100 for specific applications and as needed. The function of these elements is the same as described previously in relation to the embodiment of FIG. 2.

Yet another embodiment of the invention is illustrated in FIG. 4, which depicts a hardware implementation of the high performance actuator. In accordance with this embodiment, a missile control fin actuator that produces rotation of a control fin output shaft comprises a pressure actuator, including a housing and a compound piston slidable within the housing. The compound piston has a first face piece and a second face piece slidable relative to each other. A first rolling diaphragm seal is disposed between the first face piece and the housing wall, thereby defining a first pressure chamber of the pressure actuator between the first face piece and the housing. A second rolling diaphragm seal is disposed between the second face piece and the housing wall, thereby defining a second pressure chamber of the pressure actuator between the second face piece and the housing. A push rod is connected to the first face piece and extends out of the housing. A push sleeve is connected to the second face piece and extends out of the housing, the push sleeve overlying the push rod. Means is provided for controllably pressurizing the first pressure chamber and the second pressure chamber to cause the first face piece and the second face piece to slide within the housing and relative to each other. The push rod and the push sleeve are connected to a control fin output shaft.

FIG. 4 illustrates such an actuator 200 with two individual pressure actuators 202 operating in tandem to apply a coordinated torque to the shaft 24, in the manner described for the embodiment of FIG. 3. A pressurization system 204 for the actuator 200 is like that of the pressurization system 116 described previously in relation to FIG. 3, with cross connected pressure lines, and will not be described again. Since the two pressure actuators 202 and 202' otherwise operate in a comparable manner, only the actuator 202 will be described in detail.

One of the problems that can arise due to thermal expansion and other enviromental effects is the loosening of the taut bands that transfer the linear movement of the push rods to the rotational movement of the fin output shaft. If the bands were to become too loose, no torque could be transmitted into the output shaft with a resultant loss of control. The pressure actuator 202 avoids that problem by providing a push rod 206 and a concentric push sleeve 208 thereover, the push rod 206 being connected to an end of the taut band 210, and the push sleeve 208 being connected to one end of the other taut band 212. The other push sleeve 208' is connected to the other end of the taut band 210, and the other push rod 206' is connected to the other end of the taut band 212. When the pressure actuators 202 are operated in the manner to be described, the forces tend to tighten both of the taut bands 210 and 212 onto the shaft 24, regardless of small dimensional changes resulting from thermal expansion or dimensional tolerances during assembly.

For this approach to be effective, the push rod 206 and the push sleeve 208 must be free to move in opposite directions, and that movement is accomplished by utilizing a compound piston 214 that is slidable within a housing 216. The compound piston 214 has a first face 218 and a second face 220, slidable with respect to each other with a keying arrangement. The push rod 206 extends through a bore in the second face 220, and is fastened to the first face 218. The push sleeve 208 is fastened to the second face 220.

The pressurization actuator 202 is always operated with positive pressures in both the upper and lower pressurization chambers, so that the taut bands are forced to remain taut.

The three embodiments of FIGS. 2–4 have been illustrated with various combinations of features, valving, and gas distribution as exemplary of how this structure can be combined. It will be understood that various combinations of compatible structure may be made.

Although particular embodiments of the invention have been described in detail for purposes of illustration, various modifications may be made without departing from the spirit and scope of the invention. Accordingly, the invention is not to be limited except as by the appended claims.

What is claimed is:

1. A missile control fin actuator that produces rotation of a control fin output shaft, comprising:

a pressure actuator, including a housing, a compound piston slidable within the housing, the compound piston having a first face piece and a second face piece slidable relative to each other, a first rolling diaphragm seal between the first face piece and the housing wall, thereby defining a first pressure chamber of the pressure actuator between the first face piece and the housing, a second rolling diaphragm seal between the second face piece and the housing wall, thereby defining a second pressure chamber of the pressure actuator between the second face piece and the housing, a push rod connected to the first face piece and extending out of the housing, and a push sleeve connected to the second face piece and extending out of the housing, the push sleeve overlying the push rod;

a third rolling diaphragm seal between the push sleeve and the housing, completing the seal of the second pressure chamber;

means for controllably pressurizing the first pressure chamber and the second pressure chamber to cause the first face piece and the second face piece to slide within the housing and relative to each other; and means for connecting the push rod and the push sleeve to a control fin output shaft.

2. The actuator of claim 1, wherein the push sleeve is made of a metal, and further including a magnet adjacent the push sleeve to exert a damping force on the push sleeve.

3. The actuator of claim 1, wherein the means for connecting includes a first taut band connector that connects the push rod to the fin output shaft, and a second taut band connector that connects the push sleeve to the fin output shaft.

4. The actuator of claim 1, further including means for measuring the movement produced by the push rod and the push sleeve, and feeding back the measurement to the means for controllably pressurizing, and means for measuring the pressure in the pressure chambers and feeding back the measurement to the means for controllably pressurizing.

5. The actuator of claim 1, further including a second pressure actuator, including a second housing, a second compound piston slidable within the housing, the second compound piston having a second piston first face piece and a second piston second face piece slidable relative to each other, a second actuator first rolling diaphragm seal between the second piston first face piece and the second housing wall, thereby defining a first pressure chamber of the second pressure actuator between the second piston first face piece and the second housing, a second actuator second rolling diaphragm seal between the second piston second face piece and the second housing wall, thereby defining a second pressure chamber of the second pressure actuator between the second piston second face piece and the second housing, a second actuator push rod connected to the second piston first face piece and extending out of the second housing, a second actuator push sleeve connected to the second piston second face piece and extending out of the second housing, the second actuator push sleeve overlying the second actuator push rod, and a second actuator third rolling diaphragm seal between the second actuator push sleeve and the second housing, completing the seal of the second pressure chamber;

means for connecting the second push rod and the second push sleeve to the control fin output shaft;

a first cross connection line providing gas pressure communication between the first pressure chamber of the first pressure actuator and the second pressure chamber of the second pressure actuator; and a second cross connection line providing gas pressure communication between the second pressure chamber of the first pressure actuator and the first pressure chamber of the second pressure actuator.

6. A missile control fin actuator that produces rotation of a control fin output shaft, comprising:

a housing;

a cylindrically symmetric piston assembly slidable within the housing, the piston assembly including a first face having a first diameter, a second face having a second diameter different than the first diameter, a first rolling diaphragm that seals the first face to the interior wall of the housing, thereby defining a first pressure chamber between the first face and the interior of the housing, a second rolling diaphragm that seals the second face to the interior wall of the housing, thereby defining a second pressure chamber between the first rolling diaphragm and the second rolling diaphragm;

a push rod connected to the piston assembly and extending out of the housing;

means for controllably pressurizing the two pressure chambers to cause the piston to slide within the housing; and means for connecting the push rod to a control fin output shaft.

7. The actuator of claim 6, wherein the means for connecting has no resulting backlash when the direction of movement of the push rod changes.

8. The actuator of claim 6, wherein the means for connecting includes a taut band connector.

9. The actuator of claim 6, wherein the first face has an area twice that of the second face.

10. The actuator of claim 6, wherein the means for controllably pressurizing includes a constant pressure gas source, a first gas pressure line from the gas source to the first chamber, an inlet valve in the first pressure line, an exhaust valve in communication with the first chamber, and a second gas pressure line from the gas source to the second chamber.

11. The actuator of claim 10, wherein the first face has an area twice that of the second face.

12. The actuator of claim 10, further including an orifice in the second gas pressure line.

13. The actuator of claim 6, wherein the push rod is made of a metal, and further including a magnet adjacent the push rod to exert a damping force on the push rod.

14. The actuator of claim 6, further including means for measuring the movement produced by the push rod and feeding back the measurement to the means for controllably pressurizing.

15. The actuator of claim 6, further including means for measuring the pressure in each of the two pressure chambers and feeding back the measurement to the means for controllably pressurizing.

* * * * *